United States Patent [19]

Williams et al.

[11] Patent Number: 4,554,942

[45] Date of Patent: Nov. 26, 1985

[54] PROCESS GAS CONTROLLER

[75] Inventors: Todd E. Williams, San Jose; Steven M. Desch, Sunnyvale, both of Calif.

[73] Assignee: Advanced Micro Devices, Inc., Sunnyvale, Calif.

[21] Appl. No.: 529,898

[22] Filed: Sep. 6, 1983

[51] Int. Cl.[4] ..... F17D 3/00; B08B 9/06

[52] U.S. Cl. ..... 137/240; 137/625.11; 137/625.15; 137/625.46; 251/297; 222/148; 134/166 C

[58] Field of Search ..... 137/240, 625.11, 625.17, 137/625.18, 625.46, 625.15; 251/205, 208, 297; 222/148; 134/166 C, 167 C, 168 C, 169 C

[56] References Cited

U.S. PATENT DOCUMENTS

| | | | |
|---|---|---|---|
| 1,602,647 | 10/1926 | Carr | 137/625.11 |
| 2,706,532 | 4/1955 | Ringo et al. | 137/625.46 |
| 2,924,207 | 2/1960 | Hottenroth | 137/625.11 |
| 2,979,963 | 4/1961 | Snoy | 137/625.11 |
| 3,319,531 | 5/1967 | Sanders | 137/625.46 |
| 3,411,525 | 11/1968 | Auger | 137/625.46 |
| 3,422,848 | 1/1969 | Liebman et al. | 137/625.46 |
| 3,494,175 | 2/1970 | Cusick et al. | 137/625.18 |
| 3,674,205 | 7/1972 | Koch | 137/240 |
| 3,837,360 | 9/1974 | Bubula | 137/625.46 |
| 4,065,982 | 1/1978 | Wenger | 137/625.11 |
| 4,169,486 | 10/1979 | Otteman et al. | 222/148 |
| 4,219,049 | 8/1980 | Skelly | 137/625.46 |
| 4,383,547 | 5/1983 | Lorenz et al. | 137/240 |

FOREIGN PATENT DOCUMENTS

| | | | |
|---|---|---|---|
| 964553 | 3/1975 | Canada | 137/625.11 |

*Primary Examiner*—George L. Walton

*Attorney, Agent, or Firm*—Patrick T. King; James F. Hann

[57] ABSTRACT

A process gas controller, connected to a sources of purging and process gas, includes five valves and a pressure regulator between the process gas source and the equipment. Operating the valves provides process gas to the equipment and allows the controller to be vented of process gas and purged using the purging gas. A novel pneumatic valve controller, used to control the opening and closing of the valves, provides seven different valving combinations to supply process gas to the equipment, vent process gas and purge the system. The valve controller includes a program member having a number of passageways, each connected to one of the valves and to a program surface via program ports. A movable valve selection member overlies the program surface and includes an inlet passage coupled to a compressed source so that when the inlet passage becomes aligned with one of the various sets of program ports, compressed air is provided to the corresponding valves to actuate them.

18 Claims, 4 Drawing Figures

PROCESS GAS CONTROLLER

BACKGROUND OF THE INVENTION

Many manufacturing processes require that various types of processing gases be supplied to the equipment used. The process gases are usually contained in high pressure cylinders and are provided to the equipment through a pressure regulator.

During production it is often required to isolate the process gas cylinder, the regulator and the process gas line from the equipment. This is necessary when the process gas cylinder or the pressure regulator must be changed. When this occurs the various lines must be vented and then purged with a purging gas, such as nitrogen. To do this various valves are often employed among the purging and process gas sources, pressure regulator, vents and equipment. However, with the multiplicity of valves, lines and components, there is a substantial opportunity for an operator to open or close the wrong valve at the wrong time. Such a mistake can expose the operator and others to toxic or highly flammable gases or contaminate a cylinder of expensive process gas.

SUMMARY OF THE INVENTION

The present invention provides a process gas controller which allows the operator to safely vent and purge the process gas system when changing process gas cylinders or regulators.

The process gas controller is connected to a source of purging gas and a source of process gas to supply process gas to equipment. The controller includes a pressure regulator along a main or process gas line. The main gas line includes a main inlet connected to the process source and a main outlet connected to the equipment.

A purging gas valve is used to selectively isolate the purging gas source from the main inlet. An equipment valve is placed along the main gas line between the pressure regulator and the main outlet. An isolation valve is positioned along the main gas line between the main inlet and the pressure regulator. A low pressure vent valve is fluidly coupled between a low pressure vent and a point along the main gas line between the pressure regulator and the equipment valve. A high pressure vent valve fluidly connects a point along the main gas line between the main inlet and the isolation valve and a high pressure vent.

The various valves are manipulated to provide process gas to the equipment and allow the various lines connecting the valves, process gas source and equipment to be vented of process gas and purged using the purging gas from the purging gas source, typically nitrogen. Venting and purging usually occurs when the process gas source or the pressure regulator is changed.

Although the various valves can be manually manipulated, a novel valve controller is used to control the opening and closing of all of the valves according to the operating position selected by the user. It is preferred that the valve controller provide seven different valving combinations to properly supply process gas to the equipment, vent the process gas and purge the system with the purging gas. One of the valving combinations, in which all of the valves are closed, can be used twice to best accommodate the venting and purging procedures. Therefore, the valve controller preferably has eight operating positions in all.

The valve controller is preferably a pneumatic device in which a compressed air source is selectively coupled to the various valves to actuate them. The valve controller includes a program member having a number of passageways, each passageway connected to one of the valves. The passageways are connected to a program surface on the program member via program ports.

A valve selection member overlies the program surface and includes an inlet passage coupled to the compressed air source. The valve selection number is movable so that the inlet passage becomes aligned with various of the sets of program ports. When so aligned, the compressed air source provides compressed air to the inlet passage, through the program ports aligned with the inlet passage, into the valve passageway(s) and in to the corresponding valve(s) thus opening the valves.

A primary feature of the invention is the provision of a valve controller which eliminates most of the risk of improperly sequencing valves during venting and purging procedures. The valve controller is preferably a pneumatic device operating pneumatically actuated valves to eliminate the risks associated with electrically operated valves.

Other features and advantages of the present invention will appear from the following description in which the preferred embodiment has been set forth in detail in conjunction with the accompanying drawing.

DETAILED DESCRIPTION OF THE PREFERRED EMBODIMENT

Figure 1:
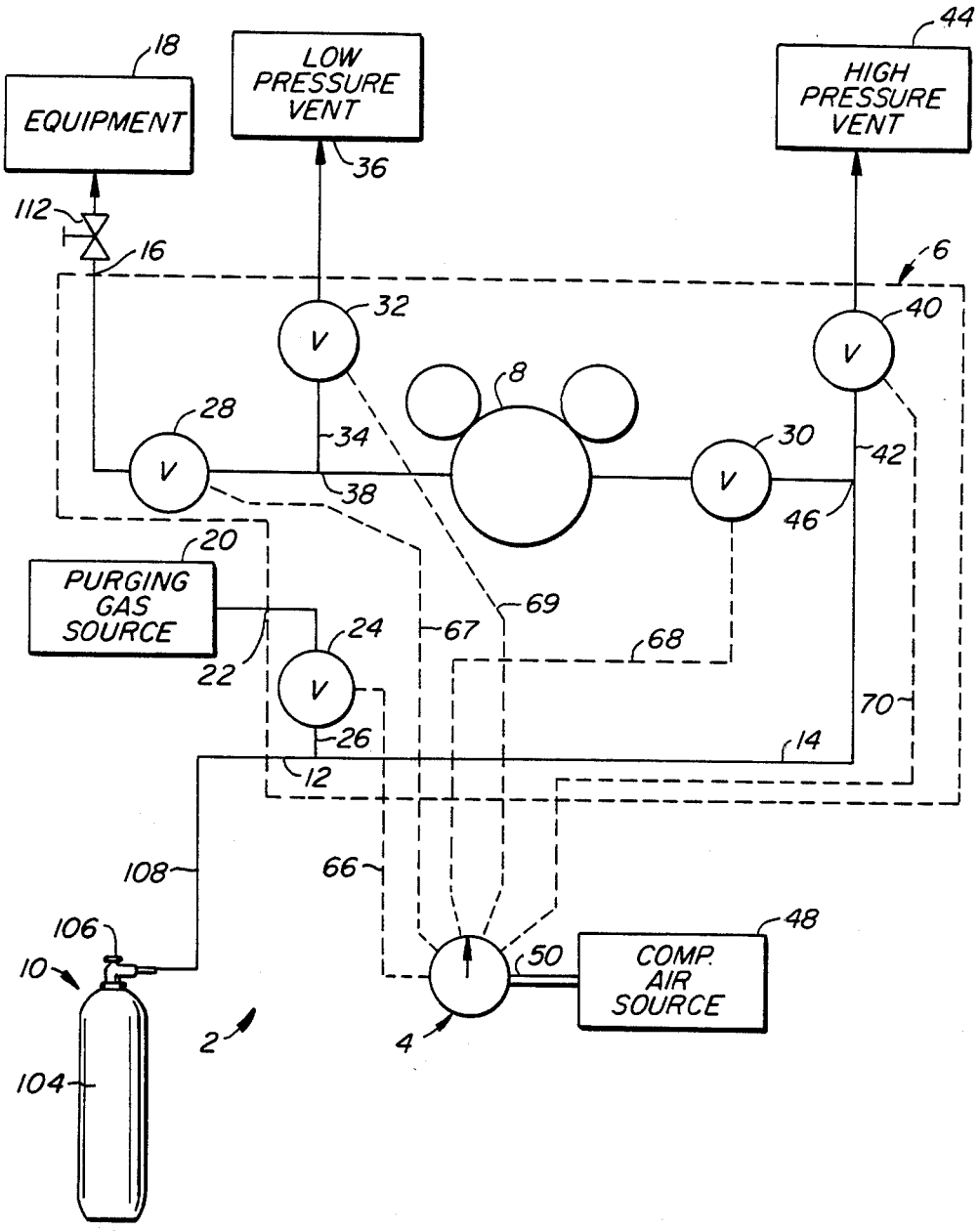
FIG. 1 is a schematic representation of a process gas controller made according to the invention.

Turning now to FIG. 1, a process gas controller 2 is seen to include a valve controller 4 operably coupled to a valve assembly 6. Assembly 6 includes various valves, described below, and a pressure regulator 8 which controls the flow of process gas from a process gas source 10, through a main inlet 12, along the main or process gas line 14, out a main outlet 16 and to equipment 18. A purging gas source 20 is fluidly connected to valve assembly 6 at a purging gas inlet 22.

The invention will be discussed in the following sequence. First valve assembly 6 will be described. Then the structure and operation of valve controller 4 will be discussed. Finally, the use of processed gas controller 2 by an operator will be described.

A first, purging gas valve 24 is positioned along a purging gas line 26 between purging gas inlet 22 and main inlet 12. A second, equipment valve 28 is located along main line 14 between main outlet 16 and pressure regulator 8. The third, isolation valve 30 is mounted between pressure regulator 8 and main inlet 12. A fourth, low pressure vent valve 32 is positioned along a low pressure vent line 34 between a low pressure vent 36 and a point 38 along main line 14 between pressure regulator 8 and equipment valve 28. A fifth, high pressure vent valve 40 is placed along a high pressure vent line 42 between a high pressure vent 44 and a point 46 along main line 14 between isolation valve 30 and main inlet 12. Valves 24, 28, 30, 32 and 40 are all normally closed pneumatically actuated valves and are used to control the flow of process and purging gas within valve assembly 6 as is described in more detail below. Valve controller 4, which actuates valves 24, 28, 30, 32 and 40, is fluidly coupled to a compressed air source 48 through a line 50.

Figure 2:
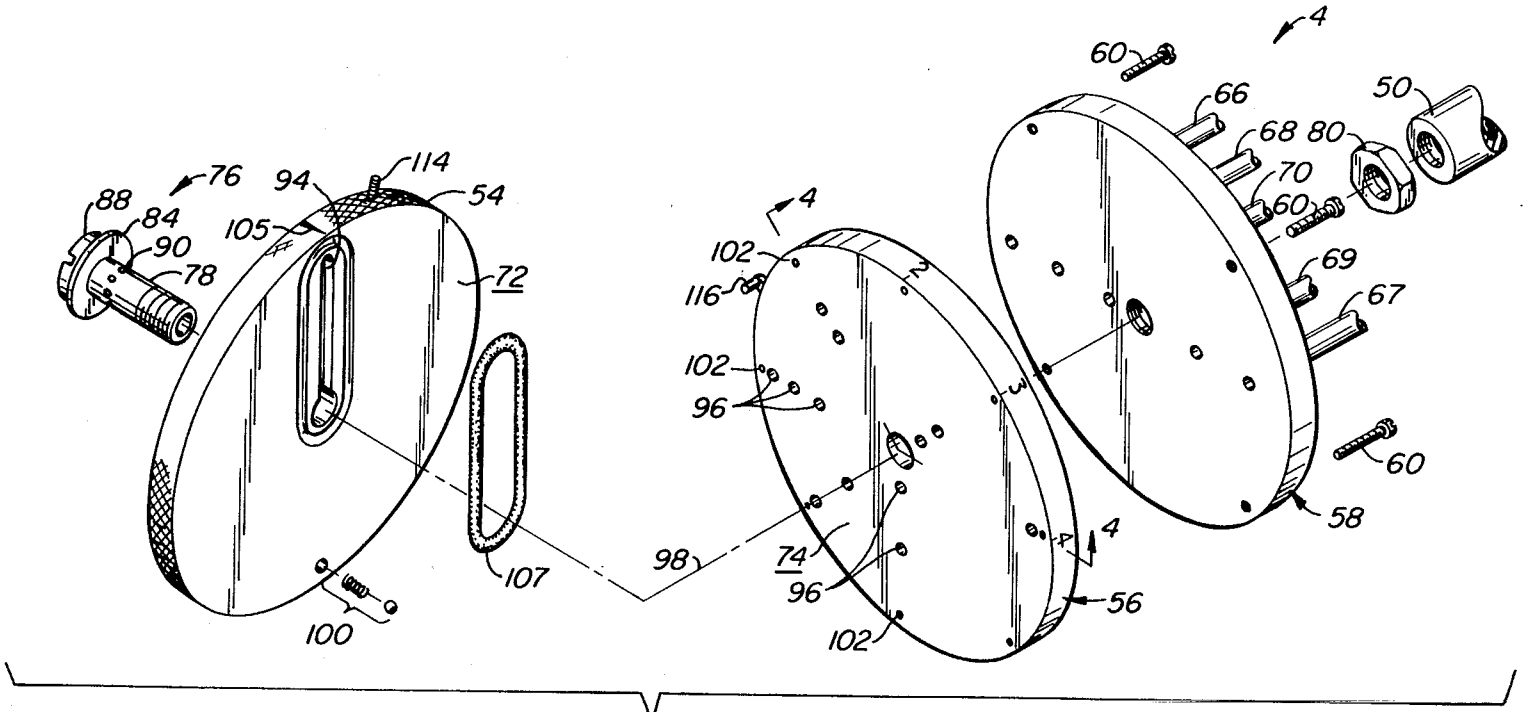
FIG. 2 is an exploded isometric view of the valve controller of FIG. 1.
Figure 3:
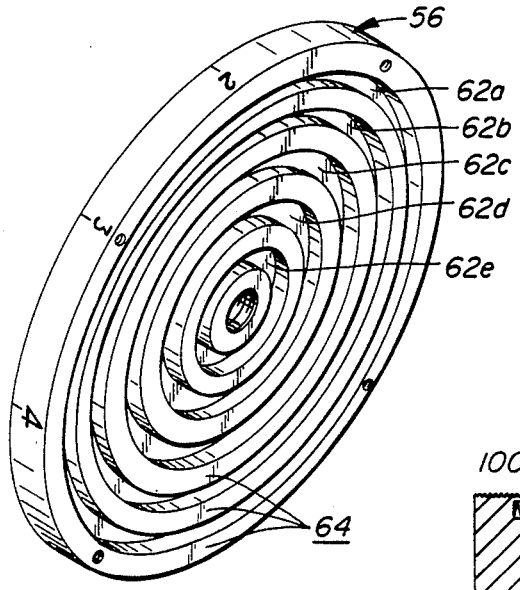
FIG. 3 is an isometric view of the side of the base disk of FIG. 2 not seen in FIG. 2.
Figure 4:
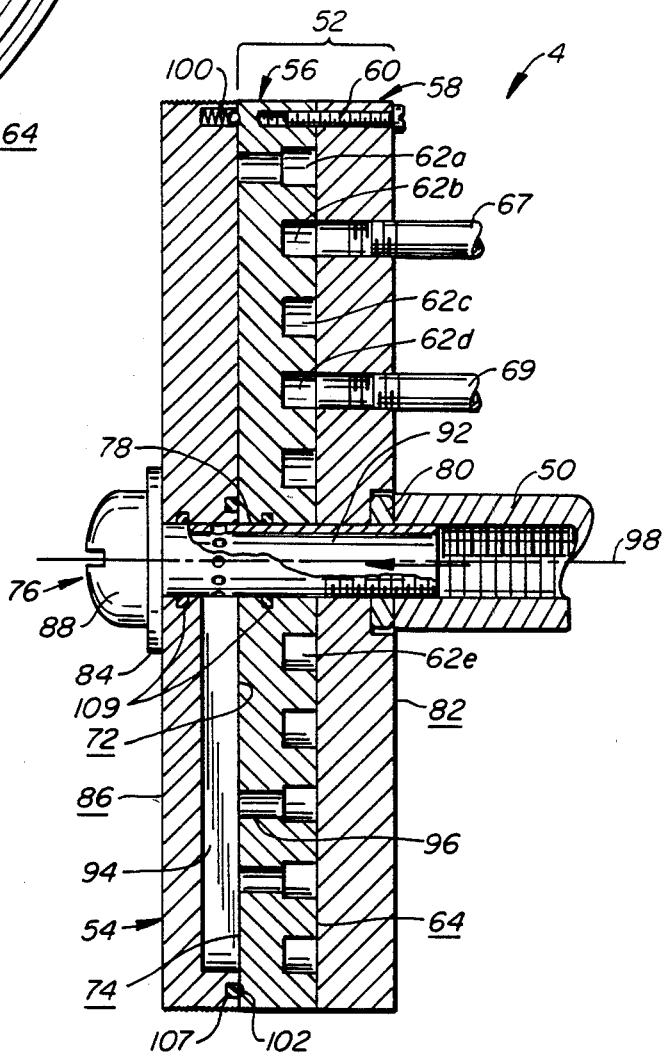
FIG. 4 is a cross-sectional view of the assembled valve controller of FIG. 2 taken along line 4—4.

Turning now to FIGS. 2–4, the physical construction of valve controller 4 is shown in more detail. Controller 4 includes a program disk 52 and an inlet, or valve selection, disk 54. Program disk 52 includes a base 56 and a cover 58 secured to one another by several screws 60. Base 56 has five circular, concentric valve passageways 62*a*–62*e* formed in an outer surface 64. The outermost through innermost passageways 62*a*–62*e* are fluidly coupled to first through fifth valves 24, 28, 30, 32 and 40 by actuation lines 66–70, respectively. Thus, pressurization of outermost passageway 62*a* actuates first valve 24 via line 66 and so forth.

Valve selection disk 54 has an inner surface 72 pivotally mounted against a program surface 74 of program disk 52 by coupling member 76. Surfaces 72, 74 are both very flat so that they conform to one another. Member 76 includes a hollow bolt 78 passing through complementary bores within disks 52, 54, a nut 80 adjacent an outer surface 82 of cap 58 and a washer 84 captured between an outer surface 86 of disk 54 and a head 88 of bolt 78. A series of vent holes 90 fluidly couple the interior 92 of hollow bolt 78 with a radially extending inlet passage 94 formed adjacent inner surface 72 of disk 54. Compressed air is therefore supplied to inlet passage 94 from source 48, through line 50, into interior 92, and through vent holes 90.

Base 56 of program disk 52 includes a number of program ports 96 connecting various valve passageways 62 to program surface 74 of base 56. A ball detent assembly 100 is mounted within disk 54 for engagement within depressions 102 in surface 74 of base 56 when passageway 94 is aligned with one of eight rotary positions, labeled 1–8 on base 56, as indicated by arrow 105. By rotating selection disk 54 about an axis 98 defined by member 76, pressurized air within passage 94 can pass through one or more program ports 96 and into their associated valve passageways 62. Excess air leakage is controlled by O-rings 107, 109.

As seen in FIG. 2, there are six sets of radially aligned program ports 96, found at the rotary positions labeled 1, 3, 4, 6, 7 and 8, having from one to three ports 96. Depending upon the rotary orientation of disk 54, pressurized air is applied to one or more valves 24, 28, 30, 32 and 40. Two of the positions, labeled 2 and 5 in FIG. 2, contain no program ports 96. When passage 94 of disk 54 is aligned with either of these positions, no air is provided to any of the valves so that all of the valves remain closed. The reason for having two positions in which all the valves are closed will become apparent when the use of the invention is discussed below.

The following table shows which valves are opened and which valves are closed when valve selection disk 54 is oriented in the eight rotary operating positions.

| Operating Position | Valve | | | | |
|---|---|---|---|---|---|
| | First | Second | Third | Fourth | Fifth |
| 1 | C | O | O | C | C |
| 2 | C | C | C | C | C |

-continued

| Operating Position | Valve | | | | |
|---|---|---|---|---|---|
| | First | Second | Third | Fourth | Fifth |
| 3 | C | C | C | O | O |
| 4 | O | C | C | C | C |
| 5 | C | C | C | C | C |
| 6 | C | C | O | C | O |
| 7 | O | C | O | C | C |
| 8 | O | O | O | C | C |

In the table, "C" means that the valve is closed while "O" means that the valve is opened. Thus the valves are open when the associated valve passageways 62 are provided with compressed air through program ports 96 from inlet passageway 94.

In use, process gas is provided from process gas source 10 to equipment 18 by opening second and third valves 28, 30 and closing first, fourth and fifth valves 24, 32 and 40. The first operating position fulfills these requirements so that the operator sets disk 54 in position 1 during standard operation.

Process gas source 10 is usually a high pressure cylinder 104 having a standard manual valve 106 controlling process gas from cylinder 104 to main inlet 12. When it is desired to replace process gas source 10, manual valve 106 is first closed. Valve selection disk 54 is then moved from the first operating position to the fourth operating position stopping briefly at the second and third operating positions. The second operating position closes all the valves while the third operating position allows gas to escape from valve assembly 6 through vents 36 and 44. The fourth operating position introduces the purging gas, typically nitrogen, from purging source 20 through main gas line 14 between purging gas inlet 22 and third valve 30. The operator then manipulates selection disk 54 back and forth between the third and fourth operating positions allowing for the pressurization and depressurization of the system with purging gas. It has been found that this should be done at least 10 times.

Selection disk 54 is then returned to the second operating position which once again closes all the valves. At this time, a new process gas source can be attached to line 108. This procedure insures that there is no moving process gas in line 108, connecting valve 106 or inlet 12 when line 108 is opened. After replacing process gas source 10, the above purge procedure, in which the operator cycles back and forth between the third and fourth operating positions to remove any entrapped oxygen, is repeated. Thereafter selection disk 54 can be returned to the first operating position. After this is accomplished, the manual valve 106 mounted to cylinder 104 is opened.

To change regulator 8, the operator follows the above procedure going from the first position to the fourth position and then back and forth between the third and fourth positions. To complete the purge, the operator advances to the fifth position, in which all valves are again closed. After this, pressure regulator 8 is replaced. Next, valve selection disk 54 is alternated between the sixth and seventh operating positions for at least 10 cycles to insure a complete purge of regulator 8. After purging, valve selection disk 54 is repositioned at the fifth operating position. After this valve selection disk 54 can be returned to the first operating position for normal use.

If it is desired to purge main gas line 14 and the various components along the line, the bottle change and regulator change purge activities described above are first done. Then selection disk 54 is placed in the eighth operating position to allow nitrogen to flow from purging gas source 20 through main line 14 and out main outlet 16.

It can be seen that the relative positioning of the operating positions insures that there is no problem in turning selection disk 54 in either direction in proceeding to the next step. However, to keep from going directly between the first and the eighth operating positions, a radial peg 114 is mounted near arrow 105 for engagement with an axially extending stop 116 mounted to the periphery of base 56 between the first and eighth operating positions.

Modification and variation can be made to the disclosed embodiment without departing from the subject of the invention as defined in the following claims. For example, valve controller 4 is shown in a disk format in which selection disk 54 rotates. Other configurations, such as one in which valve passageways 62 are straight so that inlet passage 94 is defined by a member moving along a linear path, could be used. Also, the program member and valve selection member may be cylindrical.

What is claimed is:

1. A process gas controller of the type for connection to a purging gas source and a process gas source for supplying process gas to equipment, the controller comprising:

a main gas line having a main inlet and a main outlet, said main inlet fluidly connected to the process gas source and said main outlet fluidly connected to the equipment;

a first valve positioned between the purging gas source and said main inlet;

a pressure regulator positioned along said main gas line for providing the process gas to the equipment at a regulated pressure;

a second valve positioned along said main gas line between said main outlet and said regulator;

a third valve positioned along said main gas line between said regulator and said main inlet;

a fourth valve having a fourth valve inlet, fluidly connected to said main gas line between said regulator and said second valve and a fourth valve outlet fluidly connected to a first vent region;

a fifth valve having a fifth valve inlet fluidly connected to said main gas line between said inlet and said third valve and a fifth valve outlet fluidly connected to second vent region, said first through fifth valves being operable to isolate the process gas source from the equipment, to vent gas to said first and second vent regions and to purge the main gas line with gas from the purging gas source; and a valve controller having a plurality of user selected operating positions and being coupled to a plurality of said first through fifth valves, said valve controller arranged and adapted to control the opening and closing of said plurality of valves according to the operating position chosen by the user.

2. The process gas controller of claim 1 further comprising a purging gas line along which said first valve is positioned.

3. The process gas controller of claim 1 further comprising first and second vent lines along which said fourth and fifth valves are positioned respectively.

4. The process gas controller of claim 1 wherein said valve controller includes at least eight operating positions and said valve controller controls said first through fifth valves as follows:

| Operating Position | Valve | | | | |
|---|---|---|---|---|---|
| | First | Second | Third | Fourth | Fifth |
| 1 | C | O | O | C | C |
| 2 | C | C | C | C | C |
| 3 | C | C | C | O | O |
| 4 | O | C | C | C | C |
| 5 | C | C | C | C | C |
| 6 | C | C | O | C | O |
| 7 | O | C | O | C | C |
| 8 | O | O | O | C | C |

wherein: C=closed valve and O=open valve.

5. The process gas controller of claim 1 wherein said valve controller is a fluid pressure device and includes:

a program member having passageways fluidly coupled to said plurality of valves and having fluid passage ports, fluidly coupled to said passageways, at selected positions along an outer surface of said program member; and an inlet member having an inner surface conformingly configured for mating sliding engagement with said program member outer surface, said inlet member including an inlet passage formed into said inner surface, said inlet passage adapted to fluidly engage at least one of said fluid passage ports when said valve controller is in at least one of said operating positions thereby selectively fluidly connecting said inlet passage to one or more of said plurality of valves to actuate said one or more valves.

6. The process gas controller of claim 5 wherein said program member has a disk shape.

7. The process gas controller of claim 6 wherein said passageways are concentric.

8. The process gas controller of claim 6 wherein said outer surface is flat and wherein said passageways are circular concentric grooves formed within said program member, said grooves defining a common axis.

9. The process gas controller of claim 8 wherein said program member includes a base member and a cover member, said base member including said flat outer surface, said base and cover members being fixed to one another to prevent relative movement therebetween.

10. The process gas controller of claim 8 wherein said program member and said inlet member are flat disks, said fluid passage ports being arranged parallel to the common axis and said inlet passage being arranged transverse to the common axis.

11. A process gas controller of the type for connection to a purging gas source and a process gas source for supplying process gas to equipment, the controller comprising:

a main gas line having a main inlet and a main outlet, said main inlet fluidly connected to the process gas source and said main outlet fluidly connected to the equipment;

a first valve positioned between the purging gas source and said main inlet;

a pressure regulator positioned along said main gas line for providing the process gas to the equipment at a regulated pressure;

a second valve positioned along said main gas line between said main outlet and said regulator;

a third valve positioned along said main gas line between said regulator and said main inlet;

a fourth valve having a fourth valve inlet, fluidly connected to said main gas line between said regulator and said second valve and a fourth valve outlet fluidly connected to a first vent region;

a fifth valve having a fifth valve inlet fluidly connected to said main gas line between said inlet and said third valve and a fifth valve outlet fluidly connected to second vent region; and a valve controller having a plurality of user selected operating positions and being operably coupled to said first through fifth valves, said valve controller arranged and adapted to control the opening and closing of said plurality of valves according to the operating position chosen by the user as follows:

| Operating Position | Valve | | | | |
|---|---|---|---|---|---|
| | First | Second | Third | Fourth | Fifth |
| 1 | C | O | O | C | C |
| 2 | C | C | C | C | C |
| 3 | C | C | C | O | O |
| 4 | O | C | C | C | C |
| 5 | C | C | C | C | C |
| 6 | C | C | O | C | O |
| 7 | O | C | O | C | C |
| 8 | O | O | O | C | C |

wherein: C=closed valve and O=open valve.

12. The process gas controller of claim 11 wherein said valve controller is a fluid pressure device and includes:

a program member having passageways fluidly coupled to said plurality of valves and fluid passage ports, fluidly coupled to said passageways, at selected positions along an outer surface of said program member;

an inlet member having an inner surface conformingly configured for mating sliding engagement with said program member outer surface, said inlet member including an inlet passage formed into said inner surface, said inlet passage adapted to fluidly engage at least one of said fluid passage ports when said valve controller is in at least six of said operating positions thereby selectively fluidly connecting said air inlet to one or more of said plurality of valves to actuate said one or more valves.

13. A controller for supplying fluid from a fluid source to selected fluid actuated devices comprising:

a program member having a plurality of actuation ports fluidly coupled to the devices and a plurality of coaxial passageways, each said passageway fluidly coupled to at least one said actuation port, said program member including a program surface positioned on one side of said program member and a plurality of program ports positioned within said program member and extending between said passageways and said program surface; and a selection member movably mounted to said program member, said selection member having an inner surface conformingly configured for mating sliding engagement with said program surface, said selection member having an elongate inlet passage, fluidly connected to the fluid source, formed in said inner surface and sized to fluidly connected selected ones of said program ports according to the relative positions of said program member, the identity and number of said selected ones of said program ports, corresponding to the relative positions of said program member and said selection member, being selectable independent of the arrangement of said coaxial passageways, and said selection member thereby fluidly coupling the fluid source to selected ones of the fluid actuated devices.

14. The controller of claim 13 wherein said program member is a disk-like member, said program surface being a flat surface, and wherein said passageways are circular concentric grooves formed in said program member, said grooves defining a common axis.

15. The controller of claim 13 wherein said program member includes a base and a cover, said base, said cover, and said selection member being flat disks, said inlet passage being arranged transverse to said common axis, and means for fixedly mounting said base to said cover.

16. The controller of claim 13 including at least eight operating positions and wherein said controller controls first through fifth device as follows:

| Operating Position | Device | | | | |
|---|---|---|---|---|---|
| | First | Second | Third | Fourth | Fifth |
| 1 | C | O | O | C | C |
| 2 | C | C | C | C | C |
| 3 | C | C | C | O | O |
| 4 | O | C | C | C | C |
| 5 | C | C | C | C | C |
| 6 | C | C | O | C | O |
| 7 | O | C | O | C | C |
| 8 | O | O | O | C | C |

wherein: C=closed valve and O=open valve.

17. The controller of claim 13 wherein the passageways are circular.

18. The controller of claim 17 wherein the passageways are concentric.

* * * * *